US006663657B1

(12) United States Patent
Miller

(10) Patent No.: US 6,663,657 B1
(45) Date of Patent: Dec. 16, 2003

(54) PERCUSSIVE THERAPEUTIC DEVICE

(76) Inventor: Edward W. Miller, P.O. Box 535, Salem, OR (US) 97308

( * ) Notice: Subject to any disclaimer, the term of this patent is extended or adjusted under 35 U.S.C. 154(b) by 0 days.

(21) Appl. No.: 10/307,051

(22) Filed: Nov. 27, 2002

(51) Int. Cl.[7] ..... A61H 23/02

(52) U.S. Cl. ..... 606/239; 601/107; 601/108; 606/237; 606/238

(58) Field of Search ..... 601/48, 84, 97, 601/101, 103, 107, 108, 110, 111; 606/167, 237, 238, 239

(56) References Cited

U.S. PATENT DOCUMENTS

| | | | | |
|---|---|---|---|---|
| 1,796,444 A | | 3/1931 | Dell'era et al. | |
| 2,076,410 A | | 4/1937 | McGerry | |
| 2,078,025 A | | 4/1937 | Samuels | |
| 4,088,128 A | | 5/1978 | Mabuchi | |
| 4,549,535 A | | 10/1985 | Wing | |
| 4,716,890 A | | 1/1988 | Bichel | |
| 4,841,955 A | | 6/1989 | Evans et al. | |
| 5,140,979 A | | 8/1992 | Nakasawa | |
| 5,207,697 A | * | 5/1993 | Carusillo et al. | 606/167 |
| 5,618,315 A | | 4/1997 | Elliott | |
| 6,228,042 B1 | | 5/2001 | Dungan | |
| 6,537,236 B2 | | 3/2003 | Tucek et al. | |

* cited by examiner

*Primary Examiner*—Nicholas D. Lucchesi
*Assistant Examiner*—Quang D Thanh
(74) *Attorney, Agent, or Firm*—Carl D. Crowell

(57) ABSTRACT

An improved chiropractic adjustment tool or impact tool for use both as a multiple impact tool and a single impact tool. The impact tool assembly is comprised of a solenoid driven reciprocating rod with adjustable travel and impact force. The tool is improved with the addition of a switch to convert the tool from a multiple impact tool to a single impact tool, preferably through the use of a Hall effect switch.

1 Claim, 2 Drawing Sheets

PERCUSSIVE THERAPEUTIC DEVICE

BACKGROUND OF THE INVENTION

The present invention involves the field of medical devices. More particularly, it involves the field of percussive medical devices used as chiropractic adjustment tools to move bones and relieve muscle spasms and stress.

Percussion is a treatment modality for those who suffer from musculoskeletal pain and myofascial trigger syndrome. It is a non-surgical, non-invasive procedure that may serve as a therapeutic alternative to trigger point and epidural injections or be used when other treatments have failed. Performed on an outpatient basis, percussive treatment carries little or no risk and is relatively comfortable.

As is well-known in the chiropractic art, the spines or other bones of humans sometimes go out of alignment or are otherwise mis-adjusted. This can lead to discomfort and additional physical symptoms. In such cases an adjustment of the spine or other bone to a healthy alignment can have substantial therapeutic effects.

Several attempts have been made to provide hand-held or other small devices to assist in adjusting a patient's spine or other bone by the use of impacts. However, each of these devices provide limited force, are subject to failure, and have limited application and adjustability.

Needed in the field is a single device permitting both multiple impacts and single impacts. The present invention is directed to this shortcoming in the prior art, specifically to the improvement of the prior art in providing a device that may be used selectively for single impacts or multiple impacts.

BRIEF SUMMARY OF THE INVENTION

The present invention provides a chiropractic adjustment tool or tapper that generally comprises a housing, and a motor or power source to drive an axially reciprocating rod. The reciprocating rod is disposed perpendicularly or near perpendicular to the handle. One end of reciprocating rod extends from the housing and on the extended end is a impact end with a coupler for the mounting of one or more impact heads. The other end of the reciprocating rod has a spring pair assembly to permit the ready adjustment of impact force and axial travel of the reciprocating rod.

A fan may be affixed to the housing and air is used to cool the device components including the motor, switches and circuitry.

The operation of the device is with a solenoid driving the reciprocating rod axially. The reciprocating rod is slideably mounted within the housing, transiting through the solenoid coil. The reciprocating rod is held in place by springs, affixed to the reciprocating rod to limit travel and to return the reciprocating rod to the neutral position between impacts. On activation, the reciprocating rod is accelerated axially by the solenoid. Mounted on the extended end of the reciprocating rod is one of a number of impact heads. An impact head is used to impact the patient's body. When the solenoid is reactivated, the reciprocating rod is again accelerated toward the patient's body. A typical rate of impact is twelve impacts per second. Both the speed and the force of impact are adjustable to provide optimal therapeutic effects. In a preferred embodiment, the travel and force of impact of the reciprocating rod is adjusted by adjusting the compression of the spring pair.

Though the device may be used in a manner that provides continuous pressure punctuated by impacts, the assembly also permits an impact head to provide instantaneous force without durational pressure. This is accomplished through the use of an accelerated reciprocating rod that is permitted to bounce or recoil off of the patient, providing impact force without pressure of any duration. This is advantageous as durational pressure is painful and increases bruising.

As it is desirable to be able to selectively convert the provided device from a multiple impact device to a single impact device, the specific improvement of this invention is related to this selection means. In a standard reciprocating device, circuitry provides for the device to cycle and for the impact head to rapidly reciprocate. A skilled user may be able to quickly activate and deactivate the device and allow a single impact, however when rapidly reciprocating at twelve cycles per second, this becomes difficult.

Provided is a means to deactivate the device after a single impact. Mechanical stops or locks, photoelectric or electromechanical switches triggered by activation may be used but have an unacceptable failure rate due partly to the percussive nature of the device.

Other methods of controlling the number of impacts may be accomplished through the use of complex logic circuits. However such systems become increasingly expensive due to synchronization and other problems. The very nature of the device in use involves percussive therapy. Complex logic circuits able to withstand the percussive nature of the device tend to increase component costs and failure rates.

To overcome this problem, disclosed is a of method and embodiment of selectively limiting this device to a single stroke through the use of a solid state Hall effect switch.

The Hall effect switch is comprised of a Hall effect sensor, such as those produced by Allegro Microsystems, Inc., part no. A3187LU, placed proximate the south pole of the solenoid. Other placements are available including placing a Hall effect sensor proximate the lead wire used to power the solenoid. The Hall effect sensor is integrated with the balance of the circuitry of the device. When the solenoid of the impact device is charged, a magnetic field is created and sensed by the Hall effect sensor. The Hall effect sensor then produces a current transmitted to the controlling circuitry which deactivates the Solenoid, limiting the function of the device to a single impact.

The conversion of the invention from a single impact device to a multiple impact device may be easily accomplished through the deactivation or bypassing of the Hall effect sensor.

For a more complete understanding of the present invention, reference is made to the following detailed description and accompanying drawings. In the drawings, reference numbers refer to like parts through the several views.

DETAILED DESCRIPTION OF THE INVENTION

Figure 1:
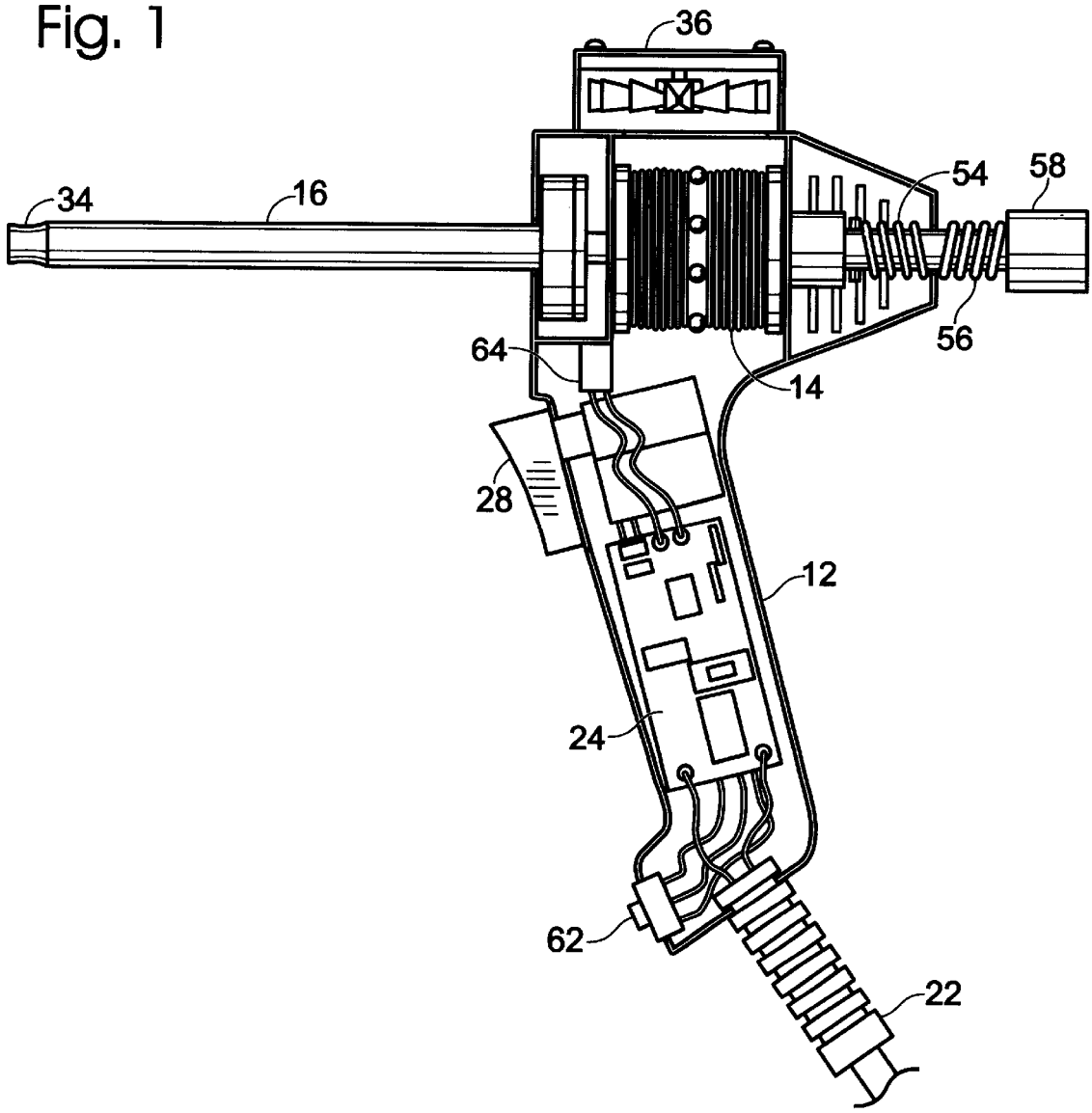
FIG. 1 is a cutaway view of the impact tool.

Referring to the drawings, there is depicted a chiropractic adjustment tool or impact tool in accordance with the present invention, depicted generally in FIG. 1. The tool comprises a housing 12, a impact assembly disposed within the housing, the impact assembly comprising a solenoid 14.

The solenoid 14 providing operational power to the impact assembly which is further comprised of a reciprocating rod 16 with an impact head 34 disposed at one end and secured to the reciprocating rod.

A fan 36 is provided for airflow to cool the solenoid 14 switches 28, 62 and circuitry 24. Other methods of moving air, including membrane driven pumps may also be used.

The reciprocating rod 16 transits through the solenoid 14 and is responsive to the force generated by the solenoid 14 such that on activation the reciprocating rod 16 is accelerated axially. A coil spring pair 54, 56, placed in series, is disposed around the rearward end of the reciprocating rod 16. A threaded annular head 58 is rotatably threaded onto the rearward end of the reciprocating rod 16 to permit adjustment of the compression of the springs 54, 56.

An electric energy source 22 is operatively connected to an activation switch 28, preferably mounted in the handle portion. The activation switch 28 is operatively connected to the solenoid 14 so that on activation, the solenoid 14 receives power. The activation switch 28 may be in any well-known form, including a "trigger" or a "button," either of which plungingly closes the circuit to the power source. In the preferred embodiment, the circuit also contains additional circuitry 24 such as a relay system or similar timing circuit to automatically activate and deactivate the solenoid 14 at an adjustable rate.

In a preferred embodiment and disclosed as the improvement of this invention, a multi point slider second switch is provided 62 to permit adjustment of the rate of the impacts or convert the tool to a single impact tool. The second switch 62 is operatively connected to the circuitry 24, which may include a disclosed 555 or similar timing chip, and connected to the Hall effect sensor 64.

Figure 2:
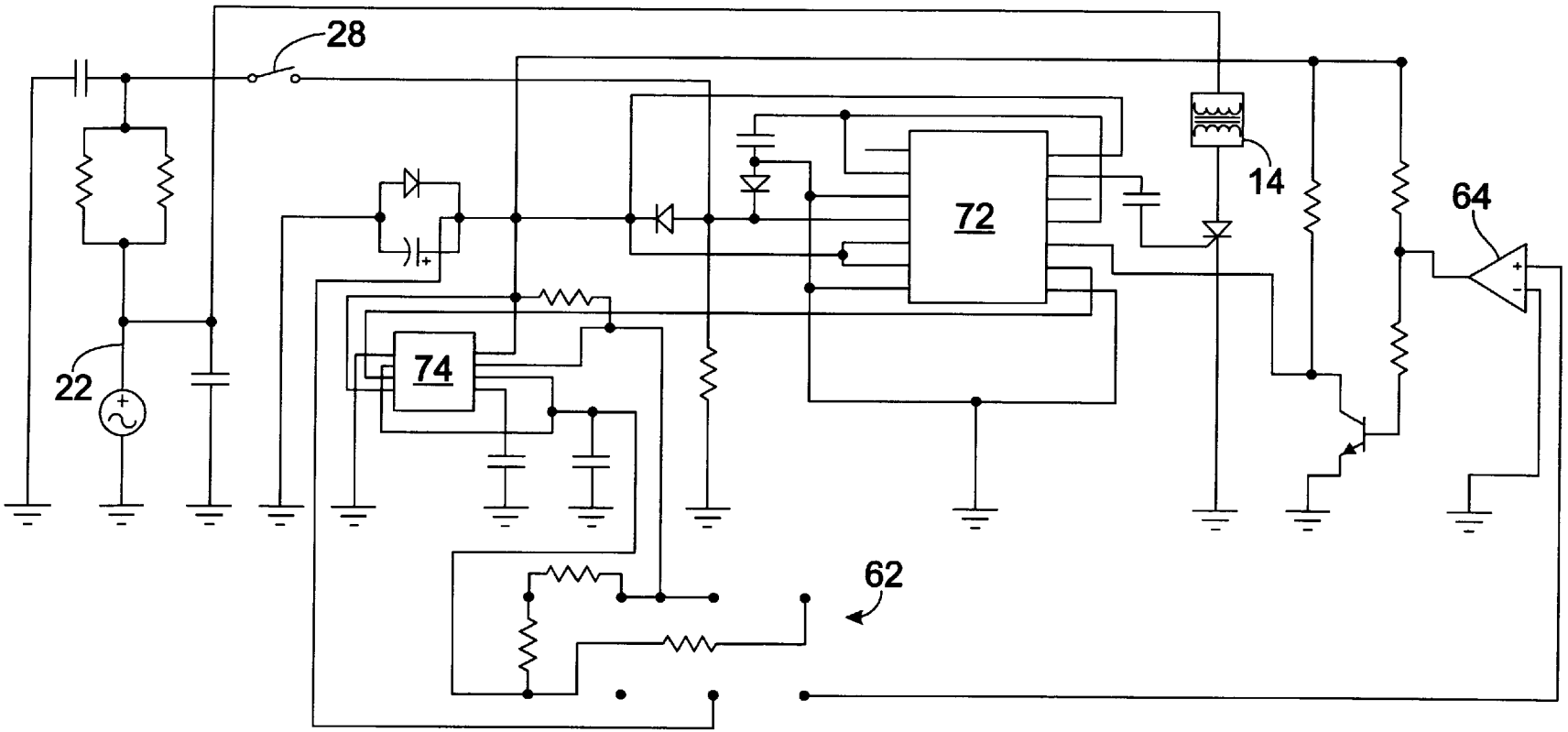
FIG. 2 circuit diagram of an embodiment of the device with a Hall effect switch.

In FIG. 2, a preferred embodiment enabling circuit diagram is provided which includes the solenoid coil 14, activation switch 28 and a second switch 62 to integrate the Hall effect sensor 64 or adjust the rate of impact in multiple impact mode. Disclosed for use in this embodiment includes a standard 555 timing circuit 74 which permits adjustment of the rate of impact of the tool, and a 4013 D-type flip-flop 72, both commonly available from a number of manufacturers.

When the power source 22 is engaged via the activation switch 28, the solenoid 14 impels the reciprocating rod 16 forward to impact the patient. When the solenoid 14 is turned off or deactivated by the circuitry 24, the reciprocating rod 16 returns to the neutral position as determined by the spring pair 52. With the use of relays or similar timing circuitry 24, the rate of impact may be established and adjusted by adjusting the timer such as by altering the resistance bridges to the 555 timing circuit 74 through settings on the second switch 62.

When the second switch 62 is set to include the Hall effect sensor 64 in the circuit a Hall effect switch is created. On the charging or activation of the solenoid 14, the Hall effect sensor 64 generates a current that is transmitted to the circuitry 24 of the tool to deactivate the tool, limiting the tool to a single impact. On release of the activation switch 28, the circuitry 24 returns to a null or zero state. On reactivation of the switch 28, with the Hall effect sensor active, a single impact is again effected.

While the invention has been illustrated and described in detail in the drawings and the foregoing description, the same is to be considered as illustrative and not restrictive in character, it being understood that only the preferred embodiment has been shown and described fully and that all changes and modifications that come within the spirit of the invention are desired to be protected.

I claim:

1. An improved impact tool for providing percussive therapy, comprising: a multiple impact percussive therapy tool with a solenoid operatively connected to a switch for activation, and a second switch operatively connected to said first switch for converting said tool between multiple impact mode and single impact mode.

* * * * *